US005507876A

United States Patent [19]

Wandres

[11] Patent Number: 5,507,876

[45] Date of Patent: Apr. 16, 1996

[54] PROCESS FOR REMOVAL OF PARTICLES ADHERING TO SURFACES BY USE OF A WIPING ELEMENT

[76] Inventor: Claus G. Wandres, Oberleien 6, D-79252 Stegen, Germany

[21] Appl. No.: 233,181

[22] Filed: Apr. 26, 1994

[30] Foreign Application Priority Data

Apr. 29, 1993 [DE] Germany ..... 43 14 046.7

[51] Int. Cl.[6] ..... B08B 1/02; B08B 1/04

[52] U.S. Cl. ..... 134/9; 134/15; 134/21; 134/32

[58] Field of Search ..... 134/9, 15, 21, 134/23, 25.1, 33, 6, 18, 34; 15/77, 80, 102, 88.2

[56] References Cited

U.S. PATENT DOCUMENTS

| | | | |
|---|---|---|---|
| 3,411,973 | 4/1965 | Siler | 156/345 |
| 4,213,873 | 7/1980 | Church | 252/174.21 |
| 4,233,271 | 11/1980 | Ernstsson et al. | 422/300 |
| 4,715,078 | 12/1987 | Howard et al. | 15/4 |
| 4,928,013 | 5/1990 | Howarth et al. | 250/339 |

FOREIGN PATENT DOCUMENTS

| | | |
|---|---|---|
| 213342A1 | 10/1993 | Germany . |
| 63-03999 | 2/1988 | Japan . |

*Primary Examiner*—Jan H. Silbaugh
*Assistant Examiner*—Robin S. Gray
*Attorney, Agent, or Firm*—Panitch Schwarze Jacobs & Nadel

[57] ABSTRACT

A process for the removal of particles (15) that are adhering to dry surfaces (2) of an object to be cleaned is carried out by means of a wiping element (5) in such a way that this wiping element (5) and the surface (2) to be cleaned carry out a movement relative to each other, and in conjunction with this, the wiping element (5) frictionally contacts the surface (2). In order that the particles (15) that are adhering to the surface (2) can be easily picked up by the wiping element (5), the wiping element (5) is moistened to such a slight extent that the particles (15) adhere better to this wiping element than to a dry wiping element, whereby, however, this amount of moisture is so chosen that the contacted surface (2) to be cleaned itself remains dry, so that the adhesive forces there would not in turn be increased by the cleaning liquid.

16 Claims, 4 Drawing Sheets

PROCESS FOR REMOVAL OF PARTICLES ADHERING TO SURFACES BY USE OF A WIPING ELEMENT

FIELD OF THE INVENTION

The invention relates to a procedure for the removal of particles adhering to dry surfaces by means of a wiping element, whereby a relative movement is carried out between the surface and the wiping element, and the wiping element contacts the surface in a rubbing manner. The invention also relates to an apparatus for carrying out the procedure.

BACKGROUND OF THE INVENTION

A number of cleaning procedures are known from practical experience. Dry cleaning procedures consist of either removal by suction or blowing, or by wiping with brushes or fleece as is described in German Offenlegungschrift 42 13 342.4.

Along with those, there are also cleaning procedures that make use of liquids, for example, high-pressure cleaning in which a surface to be cleaned is washed down, ultrasound cleaning in which the object is immersed in a liquid, or other wiping procedures, in which the surfaces in question are wiped off with liquid by means of wet cloths or similar wiping elements.

Primarily, the wet cleaning procedures have the disadvantage that in connection therewith the cleaned surface is also wet or moist, so that a drying step has to be added into the cleaning procedure, and the danger exists that particles will again affix themselves to the moist surface. In addition, dampness or moisture can change the characteristics of certain materials and workstuffs in unwanted ways; for example, it can lead to swelling.

The dry cleaning procedures have the disadvantage that particles can remain adhered, and in particular, small and very small particles, particularly if the surface itself exhibits roughness. At the least, correspondingly long and exhibits roughness. At the least, correspondingly long and tedious operational periods must be provided in the case of dry cleaning procedures. In doing this, however, there also exists the danger that, due to the rubbing of the wiping element on the surface to be cleaned, if this surface is not made of an electrically conducting material, static charges can be generated that in turn attract particles and can lead to re-contamination.

SUMMARY OF THE INVENTION

The object therefore exists of creating a procedure, and an apparatus as well, of the type mentioned at the outset, by which particles can be removed from a surface with as little effort as possible without it being necessary that this surface be subsequently dried, whereby, however, the particles can be picked up from this surface by the wiping element with correspondingly greater certainty, even if the surface has a certain roughness.

This object is achieved by moistening the wiping element in a metered fashion to such a small extent that the surface to be cleaned remains dry itself when contacted by the wiping element.

It is known that moist fibers or wiping elements can pick up dust and very fine particles better, because the moistness leads to an increased adhesion to the wiping element.

The invention thus combines the advantage of a moist wiping element with the fact that the surface to be cleaned still remains dry and thus does not have to be subsequently dried. This results in a very effective cleaning process in which particles can be removed from a surface well, not only by mechanical means, but also as a result of the adhesive capabilities of the moist wiping element, and without the surface itself becoming moist and thereby re-contaminated. If, however, some moistness is nevertheless transferred to the surface to be cleaned by the appropriately lightly moistened wiping element this moistness can only be of such a small quantity that it evaporates immediately, and thus the area to be cleaned remains dry.

The extent of moistening of the wiping element and the speed of the relative reciprocal motion between the moist wiping element and dry surface can be chosen in such a way that the liquid that is found on the fibers and/or the bristles on the wiping element wets them and remains as a film adhered to the wiping element. It is known that liquids have, on their own, a certain adhesive power due to surface tension, and the invention makes use of the fact that the adhesive forces at the boundary layer are sufficiently great, and that the wetting film roughly corresponds in its thickness to such a boundary layer.

The contact pressure between the moist element and the dry surfaces to be cleaned can be chosen so (slight) that the fibers or bristles of the wiping element provided with a liquid film come into contact with the particles that are to be picked up and take these particles along due to the strong adhesion to the liquid, and thereby no liquid is transferred to the surface to be cleaned. At the same time, it is also considered to lie within the scope of this process, when, for very short periods of time, possible traces of liquid make their way onto the surface, because these traces dry up virtually immediately, and certainly still during the cleaning process.

It is especially beneficial if the wiping element is moved continuously relative to the surface to be cleaned, and if at least one area of the wiping element is alternately dried and moistened, and if the area that is dry at a given time is itself freed of picked up particles and cleaned outside of the cleaning area. This method of proceeding thus allows the particles that were picked up by the wiping element earlier, when it was moist, to be easily loosened, because this loosening of the particles from the wiping element takes place while it is dry for a certain length of time, that is, the adhesion of the particles to the wiping element, which was at first increased by the liquid film, is now reduced by virtue of the fact that the liquid film is removed during this cleaning of the wiping element. This embodiment of the invention is therefore of very considerable importance.

An especially favorable and rapid cleaning results when two wiping elements are placed one behind the other in the direction of forward motion of the surface to be cleaned, and, in an alternating fashion, one wiping element is moistened and the other wiping element is dried, and when the dry wiping element is freed from particles that have been picked up. In this way, the surface of an object that is being moved relative to the wiping elements can thus be "moist wiped" virtually continuously, while at the same time, a cleaning of the picked up particles from the wiping elements can be carried out virtually continuously in the then-dry state.

An additional expedient embodiment of the process according to the invention can comprise, for example, a belt-like wiping element, on which neighboring zones are alternately kept moist and dry, and the zone that is dry at a given time is freed of picked up particles outside of the cleaning area. In this way is possible as well a continuous wiping on the one hand, and a continuous cleaning of the wiping element on the other, because the wiping element is cyclically moistened in one of the areas and can then clean, while it is dried in a neighboring zone and can there be cleaned itself. In doing this, one could also consider such a wiping element provided with alternating moist and dry zones as being a one-piece configuration of two wiping elements placed one before the other in the direction of forward motion of the surface to be cleaned.

The particles picked up by the wiping element can be blown from it and/or suctioned from it and/or stripped from it once it has dried.

The moistness at the surface of the wiping element can be measured and the supply of additional liquid for moistening can be regulated on the basis of the result of the measurement. By this manner of proceeding, it is thus possible to take into account the fact that the liquid that adheres to the wiping element as a film or a boundary layer is to a certain extent used up or evaporates during the cleaning process, and therefore must be continuously replenished, whereby, however, the supply of liquid cannot allow the possibility of too much liquid adhering to the wiping element and then being transferred to the surface to be cleaned. This is achieved by means of the described moistness measurement and the corresponding control of the moistening procedure.

In order to moisten the wiping element in the event of a measurement of too little moistness, the liquid can be sprayed onto the area of the wiping element that is to be moistened. In this way, the liquid is finely dispersed and, as a result of its surface tension and the adhesive forces resulting from that, can be very uniformly added to the appropriate zones of the wiping element.

The wiping element can—as already indicated—be moved transversely to the direction of forward motion of the surface to be cleaned, and can, in particular, be deflected outside of the wiping area and in this way be moved continuously and repeatedly over the surface. The cleaning procedure is thus not interrupted. As this is being done, the intensity of the cleaning can be influenced by appropriate forward feed speeds of the object to be cleaned and/or of the wiping element.

By means of the measurement of the moistness on the surface of the wiping element, at least two spray apparatus, that can be activated in an alternating fashion, can be controlled, and at any given time, only that spray apparatus triggered which sprays onto the wiping element area that is to be moistened or onto a complete wiping element that is to be moistened. The spray apparatus that is not active at any given time is then directed towards the area of the wiping element that is supposed to be dry at this time so that it can in turn be freed of the particles it has picked up.

It has already been mentioned that the continued dryness of the surface is to be considered as given, even if traces of moistness do at times make their way onto this surface but dry out and evaporate virtually immediately. In order to ensure the dryness of the surface as quickly as possible or immediately after the wiping procedure, a liquid can be chosen for moistening of the wiping element that evaporates without leaving a residue, for example, distilled water or alcohol or a mixture of the two.

Carbon dioxide and/or ammonia can be mixed into the liquid to improve the electrical conductivity of the liquid and to create an anti-static effect. The latter is of primary importance when non-conductive surfaces, for example endless belts, objects coated with plastic, or plates, are to be cleaned, since these can very quickly become strongly electrically charged during dry cleaning with a wiping element. This is not only unpleasant for people who are carrying out the cleaning, but can also serve to re-attract contaminating particles. Through use of an anti-static liquid agent, this effect can be virtually eliminated. A further advantage of this practice results because, due to the improved conductivity, the measurement of the moistness is also made easier, in that a current is directed across the moist wiping element to a measurement sensor, and this current becomes correspondingly small or is even interrupted if there is too little moistness.

One embodiment of the invention to achieve a good cleaning effect, by means of which the surface to be cleaned remains dry in spite of the moist wiping element, can lie in the fact that the speed of the forward feed of the wiping element is selected to be of such a magnitude that no transfer of liquid to the surface to be cleaned is possible, for example approximately three to six meters per second. It is clear that the transfer of moistness from a moist or wet wiping element to a surface that is contacted by it becomes less and less possible as the relative speed between the wiping element and the surface to be cleaned becomes greater and greater. From experiments it can be determined which liquids and which quantities of liquids require which forward feed speeds in order to prevent a transfer of liquid at the surface that is to be cleaned.

The apparatus according to the invention for carrying out the process described above is characterized in that it has an endless, circulating wiping element, carried on deflection rollers, and a moistening device, that a free-running cleaning section of the wiping element for contact with the surface to be cleaned is provided, and that on an opposing free-running section, running opposite to the free-running cleaning section, is arranged the moistening device as well as a moisture probe or sensor that regulates the moistening device in such a way that the moistness is so slight that the surface to be cleaned remains dry. In this way, a continuous wiping of the surface of the object to be cleaned, in particular a plate or an endless track, is possible, while the surface itself can be moved transversely to the free-running cleaning section.

Further features of this apparatus, and thus the wiping element itself as well, plus the reciprocal arrangement of the moistness probe and the moistening apparatus, are described and claimed more fully below.

In conjunction with this, the wiping element can be a fleece and/or a brush belt filled with bristles so that these bristles or the fibers of the fleece can be provided with the film of liquid that is applied to this wiping element by means of the moistening device.

There is the further possibility of arranging two endless, circulating wiping elements in such a way that their free-running cleaning sections lie opposite each other at virtually the same location, and a plate-like part that is guided between them can be cleaned on both sides simultaneously.

In sum, there results a process and an apparatus for cleaning, in which the adhesive forces of the cleaning or wiping element, be it a fleece, a brush, or a textile cloth with a fibrous surface, are increased so that the particles to be removed from the surface to be cleaned can be easily picked up by this wiping element and retained by it. That is, the molecular forces already at work between the very fine particles and the surface of the object to be cleaned are overcome, which is not always attained with certainty in the case of dry cleaning procedures. Since there is no moistness being transferred to the surface to be cleaned while this is taking place, the binding force between particle and plate is not increased at that location, which is, however, the case with cleaning procedures in which the surface to be cleaned is wet or moist.

The increased adhesive or binding force between the cleaning element and the particles that have been picked up is now eliminated in a simple way, by virtue of the fact that for the cleaning process, a brief drying of this wiping element is undertaken, for example by means of compressed air jets.

The invention thus provides for a cleaning process, as well as a corresponding apparatus, that can be classified neither as a dry cleaning procedure nor as a wet one, but rather which makes use of the advantages of both of these previously conflicting procedures without having their disadvantages.

BRIEF DESCRIPTION OF THE DRAWINGS

The foregoing summary, as well as the following detailed description of preferred embodiments of the invention, will be better understood when read in conjunction with the appended drawings. For the purpose of illustrating the invention, there are shown in the drawings embodiments which are presently preferred. It should be understood, however, that the invention is not limited to the precise arrangements and instrumentalities shown. In the drawings.

DETAILED DESCRIPTION OF PREFERRED EMBODIMENT

Figure 5A:
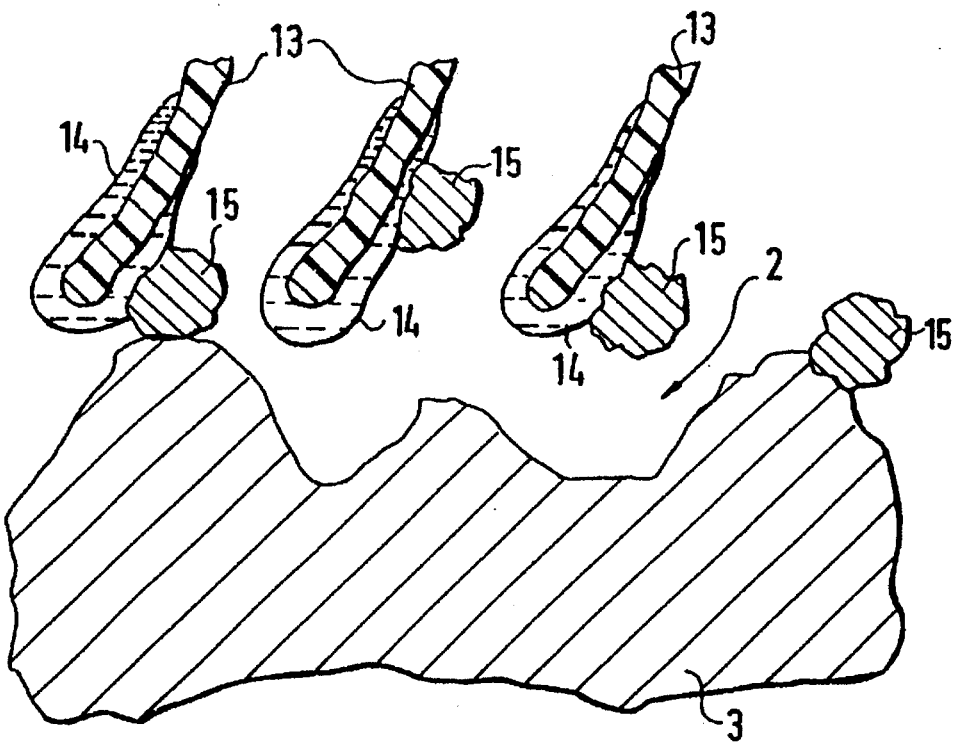
FIG. 5*a* illustrates in greatly enlarged scale, from an area of a plate shown in FIG. 5*b*, the surface roughness 30 of the plate plus particles adhering to this rough surface, as well as particles that have been removed from the plate by fibers or bristles having a liquid film.

An apparatus that is always designated as a whole with 1 in the various embodiments is used for the removal of particles 15 (see FIG. 5*a*) that adhere to the dry surface 2 of, for example, plates 3, by means of a wiping element 5. In connection with this, there is a relative movement between the surface 2 and the wiping element 5, that is described in more detail in the following. The wiping element 5 frictionally contacts the surface 2 that is to be cleaned in order to remove the particles 15 that are adhering to the surface 2 and to pick them up itself.

Figure 1:
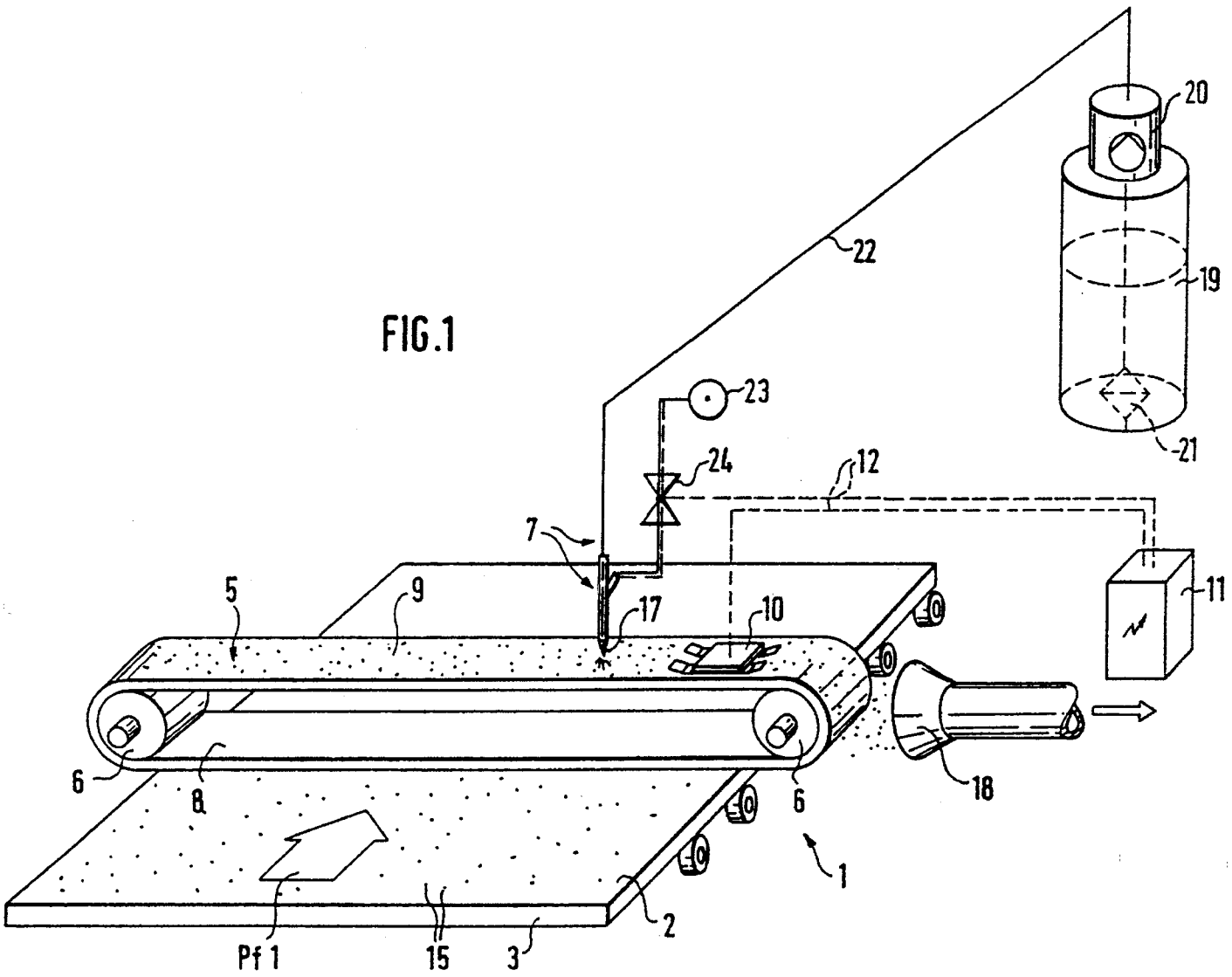
FIG. 1 shows diagrammatically in enlarged scale a wiping element that is configured as a circulating, endless belt with two reversing rollers, which impinges with its free-running cleaning section upon one surface of a plate that can be advanced at a right angle to the movement of the wiping element, whereby a moistening device and a moistness sensor for the control of the moistening device are provided as well as a suction apparatus for the cleaning of the wiping element.
Figures 3, 4:
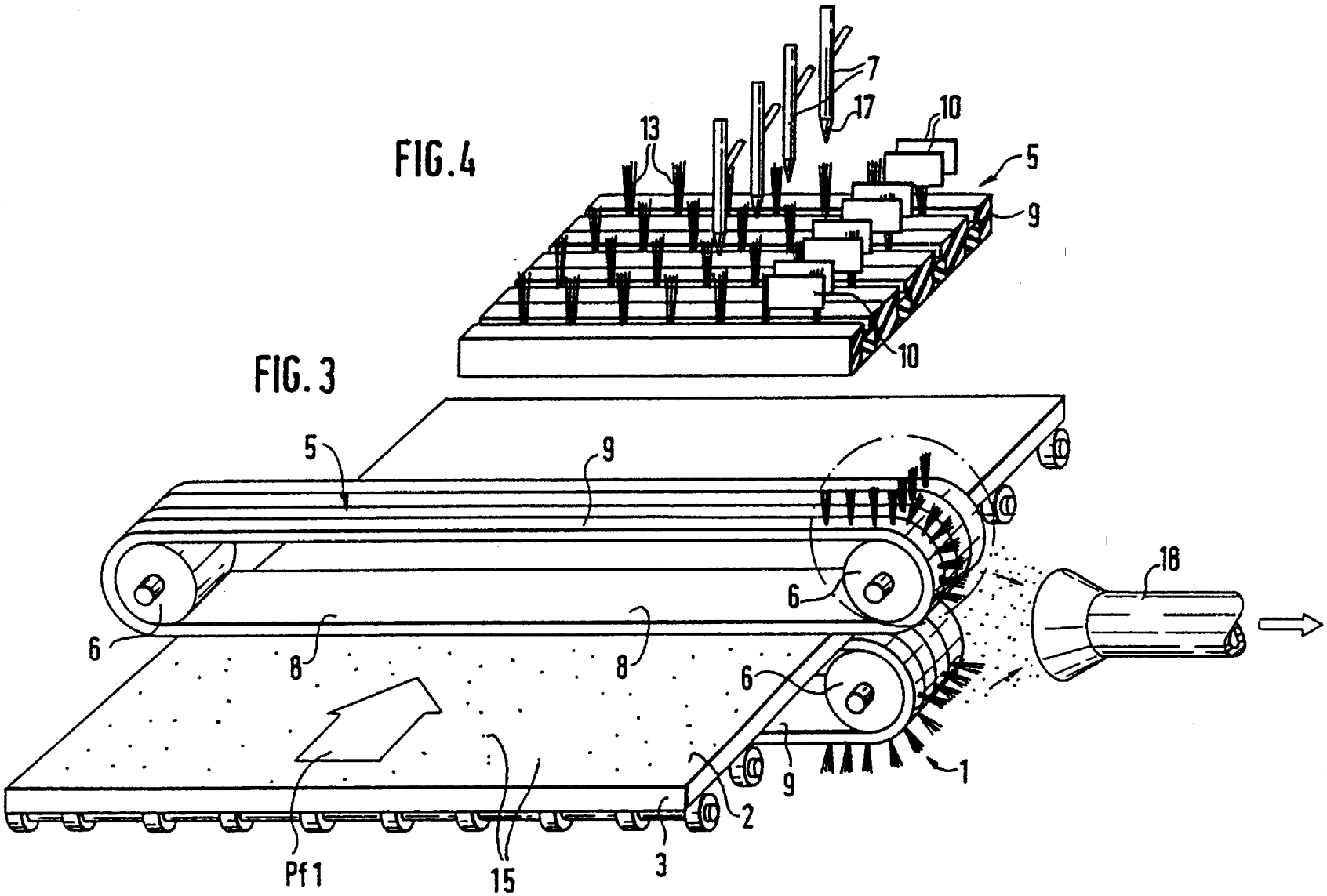
FIG. 3 shows a modified embodiment in which the wiping element is composed of belts or strips that carry individual bristles, again with two wiping elements of the same type arranged in parallel with each other for both sides of a plate or an endless track, and a suction device operating in the reversing area of both wiping elements.
FIG. 4 shows in enlarged scale a section of the wiping element provided with bristles in accordance with FIG. 3, with measurement electrodes (capacitive measurement) between the bristles.

In all of the embodiments shown, the apparatus 1 has an endless, circulating wiping element 5 that is carried on reversing rollers 6 and, in addition, at least one moistening device 7, whereby the wiping element 5 has a free-running cleaning section 8 for contact with the surface 2 to be cleaned, and the moistening device 7 acts upon the free-running opposing section 9 that circulates in the opposite direction. In FIGS. 1 and 4, one can see on this free-running opposing section 9 moistness probes 10, by means of which the moistening device 7 is controlled via a control unit 11 and wires 12 in such a way that moistening of the wiping element 5 is so slight that no liquid makes its way from the wiping element 5 onto the surface 2 to be cleaned. Only the particles 15 can absorb liquid.

Figure 5B:
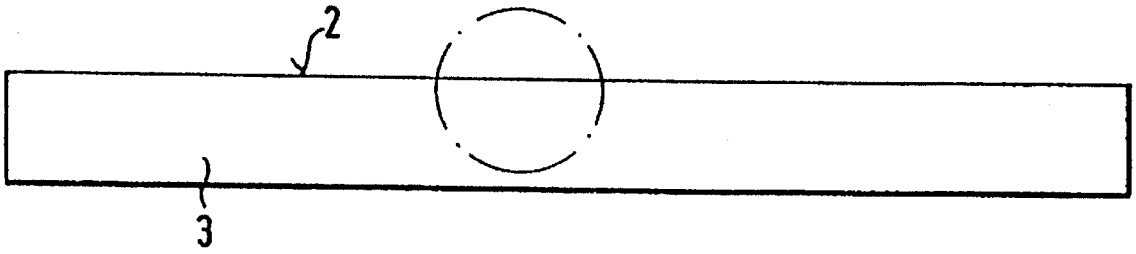

In accordance with FIG. 5, the fibers or bristles 13 of the wiping element 5 are thus surrounded by a liquid film 14 that is so thin that the operative adhesive or binding forces at the boundary layer between the liquid film 14 and the fiber or bristle 13 are large enough that the liquid is not transferred onto the surface 2 to be cleaned but is able to pick up particles 15 from the dry surface 2, whereby it is not only the mechanical wiping movement that leads to the picking up and removal of these particles 15, but also because as a result of the moisture film 14, these particles adhere better to the fibers or bristles 13 than to the surface 2. The wiping element 5 is thus moistened to such a small extent that the contacted surface 2 to be cleaned remains dry itself. Because of that, the apparatus 1 and the procedure that is to be carried out by it, make use of the fact that the particles adhere well to moist fibers or bristles, and specifically, better than to the surface to be cleaned, which remains dry. If this surface 2 were to be moistened, stronger adhesive forces for the particles would result in turn, so that they would be correspondingly difficult to remove.

In accordance with FIG. 1, the moistness probe 10—and this also holds true and is expedient for the other embodiments as well—is arranged, in the movement direction of the wiping element 5, ahead of the moistening device 7 and behind the free-running cleaning section 8, and is thus located at a point between the area of the wiping element 5 that is carrying out the cleaning and the area in which the moistness of this wiping element 5 might have to be adjusted. In this regard, the fact that the picked up particles 15 use up moistness is to be taken into account, so that the specified placement of the moistness probe is able to detect in a timely fashion whether the moistening of the wiping element 5 is no longer sufficient. In a further advancing movement of the wiping element 5, it can then be moistened additionally. In conjunction with this, one can also see in FIG. 1 that this moistness probe 10 is connected with a control unit 11, which, as already mentioned, controls the moistening device 7 by means of the wires 12. The control unit 11 can thereby take into account the fact that the extent of the moistening of the wiping element 5 and the speed of the mutual relative movement between the moist wiping element 5 and the dry surface 2 can be adjusted in such a way that the liquid that is found on the fibers and/or bristles 13 of the wiping element 5 and that wets them as a film 14 remains adhered to the wiping element 5 and does not make its way onto the surface 2 that is to be cleaned, or if it does, it is in any case as non-visible traces that evaporate immediately.

The wiping element 5 is configured as an endless belt carried on two reversing rollers 6, with a lower free-running section configured as a free-running cleaning section 8 while its upper free-running section is configured as an opposing free-running section 9 that is to be moistened. Of course, guidance via more than two reversing rollers 6 could be sensible and expedient. For example, the opposing free-running section could run over an additional tensioning roller or guide roller, which could lead to a more favorable moistening device. However, the chosen solution using two reversing rollers 6, as shown in the illustrated embodiments, is cost-effective.

At the same time, the contact pressure between the moist wiping element 5 and the dry surface 2 to be cleaned is selected to be so slight that the fibers or bristles 13 of the wiping element 5, provided with the liquid film 14, come into contact with the particles 15 that are to be picked up and carry these particles along due to the strong adhesion to the liquid, and so that no liquid is thereby transferred to the surface 2 to be cleaned, which thus remains dry.

It is expedient if the free-running cleaning section 8 of the wiping element 5 projects past the width of the surface 2 to be cleaned at least on one side, or on both sides in the embodiments illustrated such that the reversing rollers 6, that is the drive roller and the tensioning roller, lie at the edge of or outside the area in which is located the surface 2 of the plate 3 to be cleaned. At the same time, the wiping element 5 in all embodiments has a fixed mounting by means of its reversing rollers 6, and the surface 2 or plate 3 to be cleaned can be moved transversely—specifically, perpendicular in all illustrated embodiments—to the orientation and movement direction of the free-running cleaning section 8, in accordance with the arrow PF1. In the embodiments shown, the free-running cleaning section 8 is thus arranged perpendicular to the forward feed motion, indicated by the arrow PF1, of the surface 2 to be cleaned. Of course, if an angled placement were contemplated, the free-running cleaning section 8 would then have to be correspondingly longer.

The forward feed speed of the wiping element 5 is selected to be great enough that a transfer of liquid to the surface 2 to be cleaned is not possible. When wiping elements 5 with bristles are used, that is with brush-like wiping elements, the speed can amount to three meters per second or a bit less, or even more. With a fleece-like wiping element, on the other hand, a forward feed speed of about six meters per second is expedient. Since the forward feed of the actual object to be cleaned is in addition to that, there results a corresponding relative speed that prevents the transfer of fluid onto the surface 2 to be cleaned. Through experimentation, the necessary speed can be determined for each case, depending upon the surface to be cleaned and the quantity of liquid. Conversely, for a given speed the degree of moistening of the wiping element 5 can also be easily determined through experimentation, whereby care must always be taken that, during the cleaning procedure, no liquid is transferred to the surface 2 to be cleaned in the sense that the surface itself becomes moist.

As already mentioned, the wiping element 5 can be a fleece (FIGS. 1 and 2) and/or a brush belt set with bristles 13. This can depend on the composition of the surface 2 to be cleaned. It would also be conceivable for a fleece and a brush belt to be combined.

Figure 2:
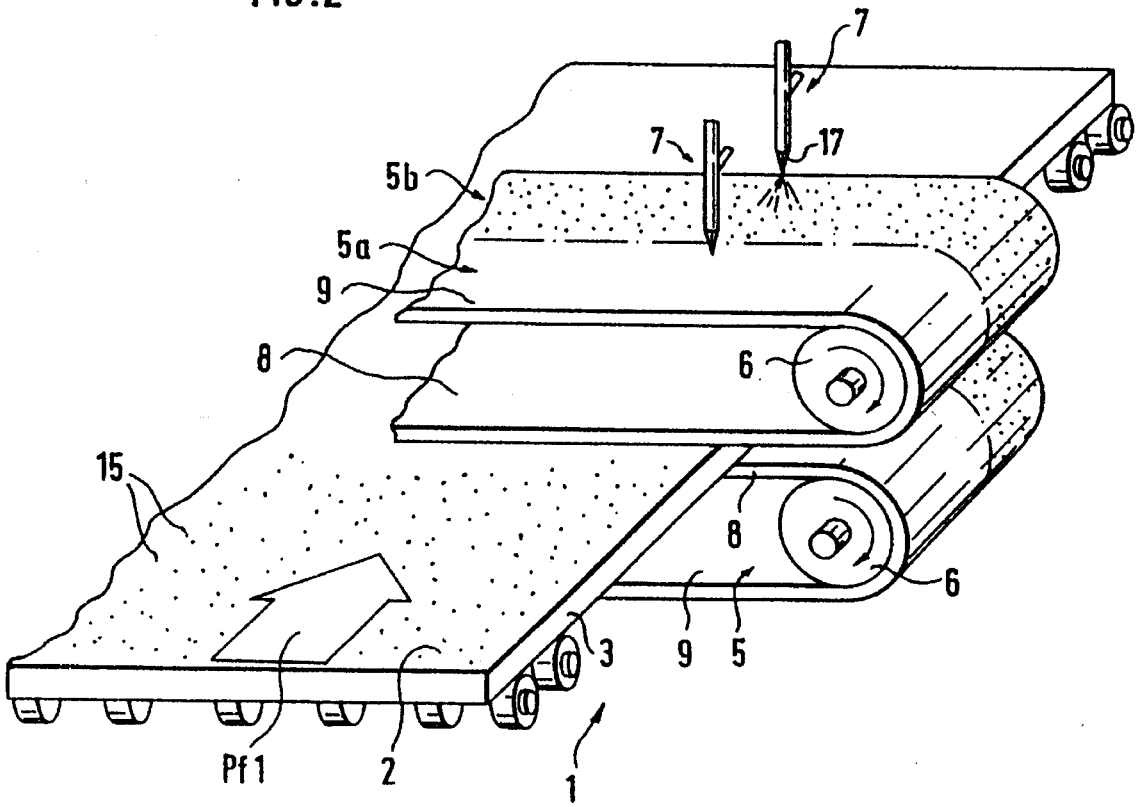
FIG. 2 shows one part of an apparatus in which a circulating wiping element is alternately kept moist in one half and dry in the other half, while at the same time there is represented in parallel with this wiping element a second wiping of the same type which can be provided, and the plate to be cleaned can be fed forward between the two wiping elements for simultaneous cleaning of both of its surfaces.

In FIGS. 2 and 3, one can see embodiments in which two endless, circulating wiping elements are shown arranged parallel to each other and whose, free-running cleaning sections 8 face each other. In particular, these elements are driven in the same movement direction since their drive rollers 6 turn in directions that are opposite to one another, whereby between these free-running cleaning sections 8 there is a free space that is used for the moving through of the plate 3 to be cleaned. In this way, the plate 3 can be cleaned on both sides simultaneously.

It can be seen in FIG. 4 that, when cleaning belts set with bristles 13 are used as wiping elements 5, a moistness sensor 10, and especially a moistening device 7, is provided for each row of bristles, or for belts of that type lying parallel, next to each other, and each having one row of bristles, if one moistening device 7 is not able to supply several rows of bristles. It is thus possible in these cases, as well as with the embodiment of FIGS. 1 and 2, to measure the moistness on the surface of the wiping element 5 and to regulate the supply of additional moistening liquid on the basis of the measurement results, so that the liquid that is used up is always replenished in a timely fashion.

As the moistening device 7, at least one spray apparatus can be used, whose outlet 17 is directed towards the wiping element 5 and, in that regard, preferably towards its free-running opposing section 9. This can be seen in all of the embodiments shown. In the event that the moistness sensor 10 detects too little moistness, the liquid used for the moistening of the wiping element 5 can thus be sprayed on the area of the wiping element 5 that is to be moistened, and can thereby be correspondingly well-distributed; whereby the spraying has the additional advantage that a correspondingly thin liquid film 14 is created.

A special configuration can be seen in FIG. 2. In accordance with FIG. 2, at least two moistening devices 7 can be provided across the width of the wiping element 5. These devices can be triggered in an alternating fashion so that at any given time, one section **5*a* of the wiping element 5 is dry, and the other section 5*b* is moistened. Outside of the cleaning area can be seen a suction device 18 for the cleaning of the wiping element 5. By means of this, it is now possible to clean the part 5*b* of the wiping element 5, that has by that time dried out, by vacuuming off the picked-up particles, which no longer adhere as well to this dry section of the wiping element 5** as they did earlier when this section was still moist.

With the embodiment of FIG. 1, it can likewise be seen that there is a suction device 18 used for cleaning which, as with all illustrated embodiments, is arranged in a reversing area for the wiping element 5. In this case, the cleaning process must be interrupted from time to time, the wiping element 5 dried out and then cleaned itself, for example by suctioning. To that extent, the arrangement in accordance with FIG. 2 is advantageous, because there the cleaning of a plate 3 or an endless belt and the cleaning of the wiping element 5, that is necessary from time to time, can be carried out simultaneously.

With the arrangement in accordance with FIG. 2, by measurement of the moistness of the surface of the wiping element 5, two alternately activatable spraying devices controlled as the moistening devices 7 in which, at any given time, only the spray device can be triggered which sprays onto the area **5*b* of the wiping element 5 that is to be moistened. In place of these two areas of the wiping element 5, it would also be possible to provide two wiping elements 5, placed one behind the other in the direction of the forward feed of the part to be cleaned, each having a moistening device 7 and a moistness probe 10, whereby these wiping elements 5 are alternately moistened and dried and operate in the same manner as the arrangement in accordance with FIG. 2, so that in such a case as well the surface 2 of a plate 3 or both surfaces of the plate 3 can be cleaned, and the wiping element itself dried from time to time and freed of the particles 15. This second solution results if the dividing line that can be seen in FIG. 2 between the moist area and the dry area is also taken to indicate, at the same time, the separation of two parallel wiping elements 5**.

In FIG. 1, it can be seen further that the moistening device 7 has a supply container 19 with a liquid pump 20 and a filter 21 at the entrance into the supply line 22 to the actual spray apparatus, as well as a compressed air source 23 and a valve 24, by means of which the liquid that is fed to the spray apparatus and its outlet 17 can be entrained and sprayed in an injector. In conjunction with this at least the valve 24 for the compressed gas or the compressed air, but possibly the liquid pump 20 as well, is controlled by the control unit 11, which is connected with the moistness sensor 10.

In FIG. 1, it can thus be seen in schematicized form how, on the one hand, the moistness measurement is taken at the wiping element 5 and on the other, how this can be converted into a control of the supply of additional liquid to the wiping element 5. It should also be mentioned in this regard that, if necessary, the endless, circulating wiping element 5 can be reversed with regard to its direction of movement and controlled in a changeable fashion with regard to its drive. This can be advantageous for the purpose of cleaning the wiping element 5 itself, or for the cleaning of a plate 3 as well under certain circumstances, for example in order to prevent single-sided wear on a fleece or on bristles 13.

In the illustrated embodiments, the particles that are picked up by the wiping element are suctioned off after a drying of one area or even of the entire wiping element. They could, however, also be blown away or stripped off, or these cleaning procedures could be combined in an expedient manner.

In the embodiments shown this cleaning of the wiping element takes place in an area outside of the wiping area. Specifically, the wiping element 5 is moved transversely to the forward feed direction of the surface 2 to be cleaned and, in conjunction with this, in each case is reversed outside of the wiping area that is defined by surface 2 to be cleaned, and can itself be cleaned in an expedient manner in this reversing area. In this way, a continuous manner of operation of this wiping element 5 is provided.

For moistening the wiping element 5, there can be stored in the supply container 19 a liquid that evaporates without a trace and comprises, for example, distilled water and/or alcohol. This has the advantage that neither the wiping element 5 nor the surface 2 to be cleaned becomes contaminated by the liquid that is used for the adhesive pickup of the particles 15 by the wiping element 5.

Carbon dioxide and/or ammonia can be mixed into the liquid to improve the electrical conductivity of the liquid and to create an anti-static effect. In this way, the frictional contacting of the surface 2 does not lead to a static charging of this surface, in case the plate 3 or another object to be cleaned is not made of metal but, for example, of plastic. In addition, because of the improved conductivity of the liquid, the moistness measurement by the dampness sensor 10 can in this way be simplified or assisted in an advantageous manner.

With the moistening of the fleece or the fine bristles 16 of the wiping element 5, moistness lodges on the surface of the fleece hairs or the bristles in the form of a moist film 14, by means of which the adhesive forces between particles 15 and these fleece hairs or bristles 13 is significantly increased. Particularly fine, microscopically small particles have the characteristic that molecular forces are already at work between the particles and the surface 2 of the plate 3 or of another object to be cleaned, so that particles 15 of that type cannot be removed with certainty and effectiveness by means of purely mechanical procedures such as dry wiping or blowing. By means of the moistening with a thin film 14, it is nevertheless possible to achieve the situation in which the surface 2 of the plate 3 is not moistened, and likewise, no amount of moisture is transferred which would result in the binding forces between particles 15 and this plate 3 being increased.

For the cleaning of the wiping element 5, the moistness can be removed for a certain time in an expedient manner, that is the wiping element 5 is dried out, so that the particles 15 can then be easily suctioned off, blown off, or, in the case of a fast-running wiping element, removed by centrifugal force or in some other way, for example in the area of a reversing roller 6 where, as a result of the bending of the endless, circulating wiping element, an additional mechanical effect (stripper) naturally takes place upon the particles 15 that are being borne by this wiping element 5.

Improved cleaning, especially in the case of heavily contaminated parts, can be attained by means of combining the moist cleaning in accordance with the invention with dry cleaning in such a way that the surface to be cleaned is first wiped off dry and then wiped off moist. Thus, before the cleaning in accordance with the invention, by which particles can be picked up with great certainty, there can be coupled a dry cleaning—possibly even by means of an additional blowing procedure—in order to remove a large portion of the contaminants, after which the final cleaning then takes place with the moistened wiping element.

The process for the removal of particles 15 that are adhering to dry surfaces 2 of an object to be cleaned is carried out by the wiping element 5 in such a way that this wiping element 5 and the surface 2 to be cleaned carry out a movement relative to one another, and the wiping element 5 thereby frictionally contacts the surface 2. In order that the particles 15 that are adhering to the surface 2 can be easily picked up by the wiping element 5, according to the invention, the wiping element 5 is slightly moistened to such an extent that the particles 15 adhere better to this wiping element than they do to a dry wiping element 5, whereby, however, this amount of moistening is so chosen that the surface 2 to be cleaned itself remains dry, so that the adhesive forces there would not in turn be increased by the cleaning liquid.

It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention as defined by the appended claims.

I claim:

1. A process for the removal of particles (15) adhering to a dry surface (2) by means of contacting said dry surface with a wiping element (5), comprising moistening a surface of the wiping element (5) with a moistening liquid thereby forming a wiping element having a moist surface (5), wherein said moistening is to such a slight extent that the dry surface (2) to be contacted by the moist wiping element (5) will remain dry when contacted by the moist wiping element, effecting a relative movement a selected speed between the dry surface (2) to be contacted and the moist wiping element (5) such that the moist surface of the wiping element (5) is moved transversely to a direction of forward feed of the dry surface (2) to be contacted and frictionally contacts the dry surface (2) thereby removing the particles from the dry surface, measuring moistness on the moist surface of the wiping element (5), applying additional moistening liquid on a regulated basis in response to said measurement of the moistness on the surface of the moist wiping element (5), and applying the additional moistening liquid to the moist wiping element (5) to maintain a desired level of moisture on the moist surface of the wiping element (5).

2. Process according to claim 1, wherein the wiping element (5) comprises at least one of fibers and bristles (13), and the extent of the moistening of the moist wiping element (5) and the speed of relative movement between the moist wiping element (5) and the dry surface (2) to be contacted are chosen in such a way that the moistening liquid wets the fibers or bristles (13) of the wiping element (5) in the form of a film (14) and remains adhered to the wiping element (5).

3. Process according to claim 2, wherein pressure of the contact between the moist wiping element (5) and the dry surface (2) to be contacted is chosen to be of such a value that the fibers or bristles (13) of the moist wiping element (5) provided with a liquid film (14) come into contact with the particles (15) to be picked up and carry the particles along due to strong adhesion to the liquid film, and substantially no moistening liquid is transferred to the surface (2) to be contacted.

4. Process according to claim 1, further comprising the steps of continuously moving the moist wiping element (5) relative to the surface (2) to be contacted, picking up particles from the surface (2) to be contacted with the moist wiping element, drying at least one area of the moist wiping element thereby forming a dry area on the wiping element, freeing the area that is dry of the picked up particles in a location away from the surface (2) to be contacted.

5. Process according to claim 1, wherein a first moist wiping element is arranged behind a second moist wiping element in a direction of forward motion of the surface to be contacted, the process further comprising picking up particles from the surface (2) to be contacted with the first and second moist wiping elements, and in an alternating fashion, applying additional moistening liquid to the first moist wiping element (5) to maintain the desired level of moisture and drying the second moist wiping element thereby forming a dry second wiping element, and freeing the dry second wiping element from particles that have been picked up.

6. Process according to claim 1, wherein the wiping element (5) is in the form of a belt with zones that neighbor each other, the process further comprising alternately moistening a first zone of the wiping element, thereby forming a moist zone, and drying a second zone of the moist wiping element, thereby forming a dry zone, picking up particles from the surface (2) to be contacted with the moist zone of the moist wiping element, and freeing picked up particles from the dry zone of the wiping element outside of the surface to be contacted.

7. Process according to claim 6, further comprising picking up particles from the surface (2) to be contacted with the moist wiping element (5), and removing the particles picked up by the moist wiping element from the moist wiping element after said drying step, said removal step being selected from the group consisting of blowing, suctioning, stripping, and centrifugal throwing.

8. Process according to claim 1, wherein if the measured moistness on the surface of the wiping element (5) is less than the desired level of moisture, spraying moistening liquid on an area (5*b*) of the wiping element (5) to be moistened.

9. Process according to claim 1, wherein the moist wiping element is moved continuously and repeatedly over the surface to be contacted.

10. Process according to claim 1, wherein by means of the measurement of the moistness on the surface of the wiping element (5) at least two spray devices are activated in an alternating fashion, said devices being controlled at any given time, so that one of the spray devices is triggered which sprays only onto an area (5*b*) of the wiping element to be moistened or onto the entire wiping element (5) that is to be moistened.

11. Process according to claim 1 wherein for the moistening of the wiping element a moistening liquid is chosen that evaporates without leaving a residue.

12. Process according to claim 11, wherein said moistening liquid is selected from the group consisting of salt-free water, low-salt water, distilled water, alcohol, and mixtures of water and alcohol.

13. Process according to claim 11, wherein the moistening liquid has an electrical conductivity, and an anti-static agent selected from the group consisting of $CO_2$ and ammonia is mixed into the moistening liquid to improve the electrical conductivity of the moistening liquid and to create an anti-static effect.

14. Process according to claim 1 wherein a forward feed speed of the moist wiping element (5) is selected to be large enough that the transfer of moistening liquid to the surface (2) to be contacted is not possible.

15. Process according to claim 14, wherein said feed speed of the wiping element is approximately three to six meters per second.

16. A process for removal of particles (15) adhered to a dry surface to be contacted (2) by means of a moistened wiping element (5) having a moist surface comprising moistening a surface of a wiping element (5) with a moistening liquid thereby forming a wiping element having a moist surface, whereby said moistening is to such a slight extent that the dry surface (2) to be contacted by the moistened wiping element (5) will remain dry when contacted by the moistened wiping element, effecting a relative movement at a selected speed between the dry surface (2) to be contacted and the moistened wiping element (5) such that the surface of the moistened wiping element (5) is moved transversely to a direction of forward feed of the dry surface (2) to be contacted, and said moist surface of said moistened wiping element frictionally contacts the dry surface (2) to be contacted to thereby remove the particles (15) from the dry surface, determining an amount of the moistening liquid to be applied to the surface of the wiping element based on the speed of relative movement between the moistened wiping element (5) and the dry surface (2) to be contacted such that the moistening liquid wets fibers or bristles (13) of the wiping element (5) in the form of a film (14) and the dry surface (2) contacted by the moistened wiping element (5) remains dry.

* * * * *